United States Patent [19]

Carr et al.

[11] 4,180,049

[45] Dec. 25, 1979

[54] OVEN ASSEMBLY AIR CIRCULATION SYSTEM

[75] Inventors: Keith E. Carr; Vance A. Kimball, both of Lincoln Township, Berrien County, Mich.

[73] Assignee: Whirlpool Corporation, Benton Harbor, Mich.

[21] Appl. No.: 867,831

[22] Filed: Jan. 9, 1978

[51] Int. Cl.[2] ..... F24C 15/32

[52] U.S. Cl. ..... 126/21 A; 126/21 R; 126/273 A; 126/198; 219/400

[58] Field of Search ..... 126/21 R, 21 A, 198, 126/20.1, 273 A; 219/399, 400; 312/236

[56] References Cited

U.S. PATENT DOCUMENTS

| | | | |
|---|---|---|---|
| 2,965,095 | 12/1960 | Pearce et al. | 126/21 R |
| 3,057,341 | 10/1962 | Perl | 126/21 R |
| 3,180,331 | 4/1965 | Jenn et al. | 126/21 A |
| 3,205,884 | 9/1965 | Locher | 126/273 A |
| 3,659,579 | 5/1972 | Henderson et al. | 126/21 A |
| 3,739,146 | 6/1973 | Gilliom | 126/21 R |
| 3,783,219 | 1/1974 | Tateda | 219/400 |
| 3,818,171 | 6/1974 | Miller | 126/21 A |
| 3,889,099 | 6/1975 | Nuss | 126/21 A |
| 3,911,893 | 10/1975 | Baker et al. | 126/21 A |
| 3,924,601 | 12/1975 | Nuss | 126/21 R |

*Primary Examiner*—Samuel Scott

*Assistant Examiner*—Daniel J. O'Connor

*Attorney, Agent, or Firm*—Wegner, Stellman, McCord, Wiles & Wood

[57] ABSTRACT

An assembly of vertically spaced ovens with an air passage at the bottom of the upper oven and top of the lower oven having an inlet at the rear, and an outlet at the front of the assembly. An air moving device is provided for causing air flow forwardly through the passage to cool the oven structure. At least one of the ovens may be a microwave oven and the air moving device may serve to draw air from the interior of the microwave oven for delivery forwardly through the passage. At least one of the ovens may be provided with a front door having a vertical air flow passage for convective cooling of the door. The forward passage outlet may be disposed adjacent the upper end of the door vertical passage whereby the forceful air movement from the air moving device may draw air through the vertical passage for improved cooling of the door. A thermostat control may be provided for causing automatic operation of the air moving device. At least one of the ovens may include an integral air circulating structure to provide independent cooling thereof. The air moving device may draw air from about the upper oven and through the upper oven for delivery forwardly through the passage between the ovens.

19 Claims, 3 Drawing Figures

OVEN ASSEMBLY AIR CIRCULATION SYSTEM

BACKGROUND OF THE INVENTION

1. Field of the Invention

This invention relates to oven assemblies and in particular to means for providing forced air cooling of oven assemblies.

2. Description of the Prior Art

For improved operation of ovens, such as domestic cooking ovens, it has been conventional to provide forced air cooling means. Illustratively, George B. Long shows, in U.S. Pat. No. 2,860,026, an electronic oven having a fan for drawing room air around the power tube, wave guide and electronic apparatus to cool the same and return the thusly warmed air to the room. The air is drawn in by the fan through an inlet below the oven and circulated past the apparatus outwardly of the oven cavity and is then discharged through a front opening at the top of the oven cavity.

Leonard Velander, in U.S. Pat. No. 3,308,261, shows a microwave oven construction having a first duct connected to a source of pressurized air and arranged to exhaust air to the exterior of the oven. A second duct communicates between the cooking cavity in the oven and the first duct so as to provide aspiration of the air from the cooking cavity.

Kenneth E. Rawald et al, in U.S. Pat. No. 3,384,067, show a forced air cooling and ventilating system for a self-cleaning oven wherein a heater control is provided interlocked with a fan to permit self-cleaning operation of the oven only when the fan means is operating. An air jacket is provided between the oven shell and a housing surrounding the shell with suitable venting openings provided therein to permit exhausting of the gases from the oven with the exhausting gases mixing with cool air from the outside of the oven.

In U.S. Pat. No. 3,485,229, John W. Gilliom shows a built-in oven cooling system wherein the oven is supported in an outer casing through which a blower circulates ambient air with all of the flow in the casing being directed by baffling over the top front portions of the sidewalls of the oven. Exhaust products from the cooking cavity are conveyed through a duct exposed to the cooling air flow within the casing. The exhaust gases and cooling air are delivered through an upper outlet at the front of the oven and the cooling air is delivered to below the oven through an outlet also at the front of the oven.

In U.S. Pat. No. 3,818,171 of Matthew S. Miller et al, an eye-level microwave oven is mounted on a subjacent stove having cooking burners disposed below the oven. A ventilation duct extends upwardly from the stove to the microwave oven to terminate either at the bottom or the back of the microwave oven as desired. The cooling air may be exhausted through openings at the top of the oven.

SUMMARY OF THE INVENTION

The present invention comprehends an improved oven structure providing for improved cooling of a plurality of ovens arranged in spaced juxtaposed disposition.

In the illustrated embodiment, the oven structure includes an upper oven spaced above a lower oven. The upper oven may comprise a microwave oven having an integral air flow system for self-cooling thereof.

The lower oven, in the illustrated embodiment, comprises a baking oven which may be suitably heated as by electrical or gaseous fuel heating means, which may include a front door having one or more vertical air flow cooling passages for convective cooling of the door in the normal use of the oven.

An air moving means may be provided for causing cooling air flow from a rear portion of the oven structure forwardly to an outlet at the front of the oven structure which may be disposed at the top of the lower oven door and below the door front of the upper oven.

Thermostatic control means may be provided for causing automatic operation of the air moving means to effect the desired cooling of the oven structure when the temperature sensed by the thermostatic control means reaches a preselected high temperature.

Where the upper oven comprises a microwave oven having an integral air circulating means, the air may be discharged from the microwave oven thereby through an upper opening near the front of the oven structure.

Where the thermostatic device which controls the air moving means senses a high temperature in the upper portion of the oven structure, the air moving means may cause a delivery of the air from the space surrounding the microwave oven through the passage between the ovens and concurrently cause flow of air through the upper opening of the oven structure for mixing with the air discharged from the microwave oven prior to delivery thereof to the passage between the ovens.

In the illustrated embodiment, the air flow passage overlies the top of the bottom oven and underlies the bottom of the top oven. The air moving means may be disposed rearwardly of the upper oven so as to discharge the cooling air into the rear end of the passage for flow therethrough through an outlet at the front of the oven structure.

The delivery of the air from the outlet at the front of the oven structure may be arranged to suck air from the top of the vertical convective air flow passages of the lower oven front door so as to provide an augmented cooling action relative to the lower oven front door.

More specifically, the outlet from the passage may be disposed superjacent the upper end of the vertical convective air flow passages of the lower oven door whereby the forced air flow from the passage moves across the opening of the vertical air flow passages to aspirate air therefrom in a venturilike action.

The oven structure may be enclosed in an outer cabinet. The temperature sensing means may be disposed in the upper portion of the cabinet so as to sense a high temperature condition caused by heating in either or both of the ovens.

The air moving means and air flow passage between the ovens may be arranged to exhaust in a direction generally away from the oven structure so as to effectively minimize the reintroduction of heated air into the cooling system.

The oven structure of the present invention is extremely simple and economical of construction while yet providing the highly desirable improved functioning and features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
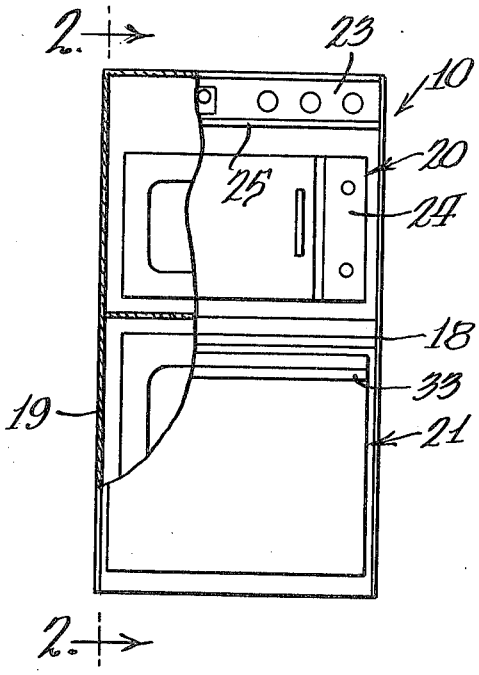
FIG. 1 is a front elevation with a portion broken away to facilitate illustration of the invention, of an oven structure embodying the invention.

In the exemplary embodiment of the invention as disclosed in the drawing, an oven structure generally designated 10 is shown to include an outer cabinet 11 defining an upper space 12 and a lower space 13. The cabinet defines a front opening 14, an upper wall 15, a bottom wall 16, a rear wall 17, a left wall 18, and a right wall 19.

A first oven generally designated 20 is disposed in upper space 12 and a second oven generally designated 21 is disposed in lower space 13. The upper oven may be supported in the cabinet by suitable supporting brackets, such as brackets 22, and in the illustrated embodiment, the lower oven 21 is supported on the bottom wall 16 of the cabinet. As will be obvious to those skilled in the art, the cabinet may comprise an integral extension of the sidewalls of the lower oven 21 within the broad scope of the invention.

A suitable manually operable control panel 23 may be provided at the top of the front opening 14 of the cabinet. In the illustrated embodiment, the control panel is provided for controlling operation of the lower oven 21 and a separate control panel 24 is provided on the upper oven 20, it being understood that the control 23 may incorporate controls for both ovens as desired.

In the illustrated embodiment, vent openings 25 are provided adjacent the control panel 23 for venting the upper space 12 at the front of the cabinet.

Figure 2:
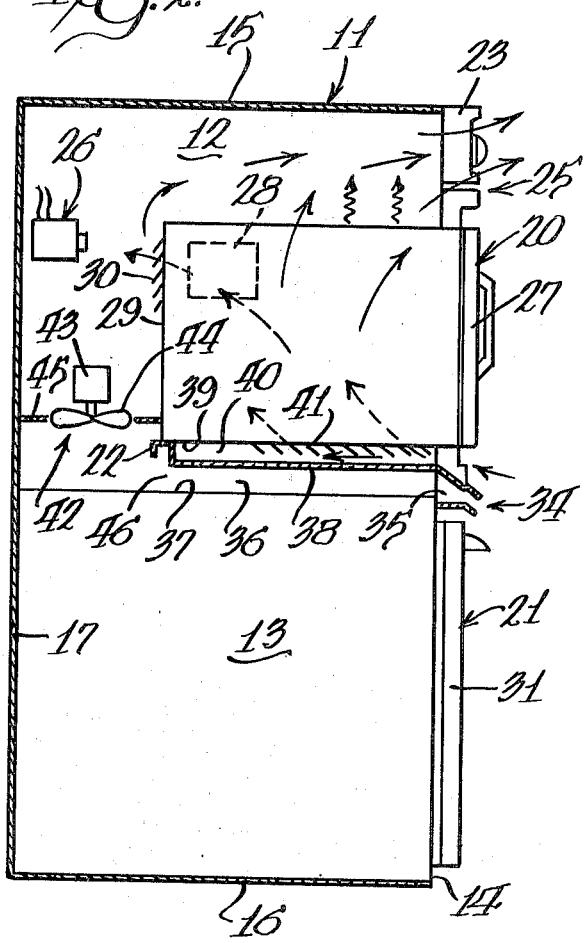
FIG. 2 is an enlarged vertical section taken substantially along the line 2—2 of FIG. 1.

A conventional thermostatic control switch generally designated 26 may be provided in upper space 12 adjacent the rear wall 17 and subjacent the top wall 15, as shown in FIG. 2 of the drawing.

The upper oven 20 may comprise a conventional microwave oven having a front access door 27 and provided with a conventional air moving system 28 for effecting forced air cooling of the oven 20 during normal operation thereof. As illustrated in FIG. 2, the air moving system 28 may cause air flow through the interior of the oven 20 and outwardly therefrom through the upper vent openings 25. Toward this end, the rear wall 29 of the oven 20 may be provided with a suitable louvered outlet 30. As shown in FIG. 2, the thermostatic control 26 may be disposed adjacent the louvered outlet 30 so as to have temperature sensing relationship with the air being exhausted through the louvered outlet.

Figure 3:
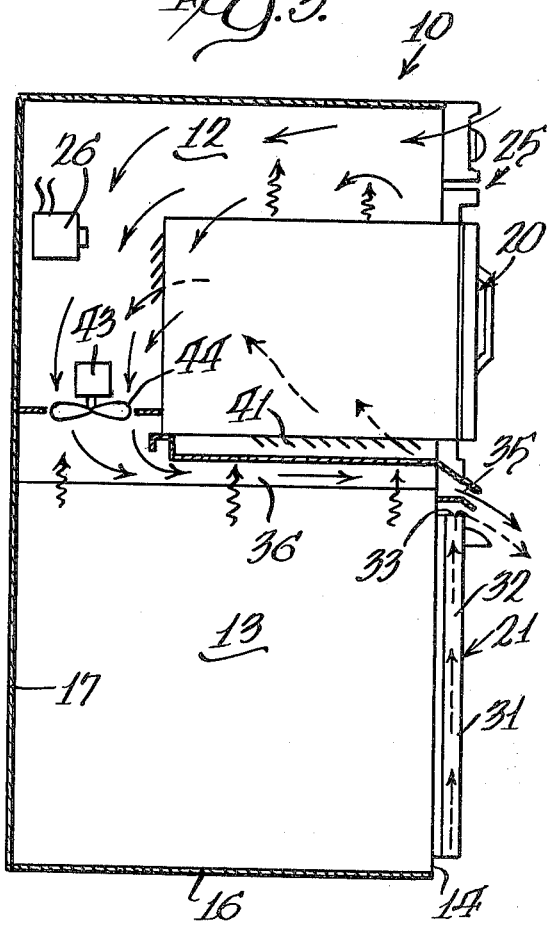
FIG. 3 is a view similar to that of FIG. 2 but illustrating the air flow through the oven structure as during a concurrent heating operation of both ovens thereof.

The lower oven 21 may comprise a conventional domestic baking oven which may be heated as desired, such as by electrical or gaseous fuel heating means. Oven 21 may be provided with a selectively movable front door 31 having one or more vertical convective air flow passages 32, as shown in FIG. 3. The air flow passages define an upper outlet 33 at the front upper portion of the oven 21.

As further shown in FIGS. 2 and 3, cabinet 11 is provided with a pair of baffle plates generally designated 34 overlying the lower oven door 31 and defining a restricted outlet passage 35.

Oven cooling air is delivered to the outlet passage 35 through a passage 36 defined by the top wall 37 of the lower oven 21 and a divider wall 38 spaced above the lower oven wall 37 and below the bottom wall 39 of the upper oven 20, as best seen in FIG. 2.

As further shown in FIG. 2, the space 40 above the divider wall 38 and below the top oven bottom wall 39 defines a passage for conducting cooling air from the front of the oven structure therethrough and into a suitable louvered inlet 41 to the upper oven 20.

An air moving means generally designated 42 is provided for causing forced air flow of cooling air fowardly through passage 36 and outlet passage 35 from the rear portion of the oven space 12. As shown in FIG. 2, the air moving means may comprise an electric motor 43 driving a suitable fan 44 provided with a shroud 45. Thus, fan 44 may deliver air through an inlet 46 to passage 36 from the upper space 12 so as to provide cooling of the upper space in the operation of the oven structure.

As indicated briefly above, when the upper oven 20 is being operated independently of the lower oven 21, the forced air cooling means 28 thereof may effectively maintain the temperature within the upper cabinet space 12 below the temperature at which control 26 causes operation of the fan motor 43 so that the cooling air may be drawn in through the passage 40 from the lower front of the upper oven 20 and discharged from the space 12 through the outlet openings 25 at the top of the upper oven 20.

In the event the temperature within the upper space 12 rises above the preselected setting of the thermostat control switch 26 notwithstanding the operation of the cooling means 28 of the oven 20, the control 26 causes an automatic operation of the fan motor 43 so as to cause fan 44 to draw the air from space 12, as shown in FIG. 3, and delivery through passage 36 and its outlet 37 to forwardly of the oven structure. As shown in FIG. 3, not only is the air delivered from the upper oven louvered outlet 30 drawn by the fan 44, but also air is drawn rearwardly through the vent opening 25 to mix with the air from the oven 20 and thereby provide a further cooling of the upper oven 20.

When the lower oven 21 is being operated so as to heat the lower space 13, the rising hot air causes operation of the control switch 26 to cause energization of the fan motor 43 and thereby cause a cooling flow of air through the passage 36.

As discussed above, the vertical door cooling passages deliver the convective air flow therethrough through the upper opening 33 thereof. As shown in FIG. 3, opening 33 is closely subjacent the outlet 35 of passage 36 so that the rapidly moving air flowing from the constrictive outlet 35 acts as a venturi in sucking air from the outlet 33 thereby enhancing the upward cooling flow of air through door 31 and providing improved cooling of the lower oven door.

At the same time, as shown in FIG. 3, the forced air delivery from outlet 35 causes the cooling air to flow away from the oven structure 10 so as to minimize recirculation of the warm air back to the cooling system. As shown in FIG. 3, the outlet 35 may be directed downwardly and forwardly so as to be directed away from any cooling air flowing into the passage 40 from the front of the upper oven 20.

Thus, the improved air cooling effected by fan 44 not only provides heat transfer between the forced air cooling flow but also synergistically augments the integral cooling operation of the upper oven air flow means and the lower oven door convection cooling means. Control 26 assures the operation of the fan 44 only when desirable to maintain the desired temperature conditions within the oven structure and, thus, provides efficient utilization of heat energy while yet assuring long troublefree life of the oven structure elements.

The foregoing disclosure of specific embodiments is illustrative of the broad inventive concepts comprehended by the invention.

Having described the invention, the embodiments of the invention in which an exclusive property or privilege is claimed are defined as follows:

1. In an oven structure having an upper oven defining a bottom, a rear, and a front, and a lower oven disposed subjacent said upper oven bottom and having a rear, a top, and front, improved means for directing cooling air through said oven structure comprising:

air moving means; and wall means defining a passage spaced below the bottom of said upper oven and open to the top of said lower oven and having an inlet at the rear of at least one of said ovens and an outlet at the front of at least one of said ovens, said air moving means being arranged to flow oven cooling air firstly in heat transfer association with the bottom of said upper oven and then to said inlet for flow through said passage for cooling said top of the lower oven.

2. The oven structure of claim 1 wherein said air moving means is disposed at said passage inlet.

3. The oven structure of claim 1 wherein said passage is disposed below said upper oven bottom.

4. The oven structure of claim 1 wherein said passage is disposed above said lower oven top.

5. The oven structure of claim 1 wherein said passage is disposed between said upper oven bottom and said lower oven top.

6. The oven structure of claim 1 wherein at least one of said ovens comprises a microwave oven having internal cooling passages and said air moving means is disposed to flow air through said cooling passages and from said cooling passages to said inlet.

7. In an oven structure having an upper oven defining a bottom, a rear, and a front, and a lower oven disposed subjacent said upper oven bottom and having a rear, a top, and a front, improved means for directing cooling air through said oven structure comprising:

air moving means;

wall means defining a passage at the bottom of said upper oven and top of said lower oven having an inlet at the rear of at least one of said ovens and an outlet at the front of at least one of said ovens, said air moving means being arranged to flow oven cooling air through said passage for cooling said oven structure;

cooling means for providing air flow cooling of said upper oven alone; and temperature responsive means for causing operation of said air moving means as an incident of a temperature condition of said upper oven rising above a preselected temperature notwithstanding the cooling of said upper oven by said cooling means.

8. The oven structure of claim 7 wherein said cooling means defines an upper passage having at least a portion above said upper oven and having an air flow port at said front of the upper oven.

9. The oven structure of claim 7 wherein said cooling means defines an upper passage having at least a portion above said upper oven and having an air flow port at said front of the upper oven, said port defining an outlet opening when said cooling means is operating and said air moving means is inoperative, and defining an inlet for delivering cooling air through said upper passage to said air moving means when said air moving means is operating.

10. The oven structure of claim 7 wherein said cooling means defines an upper passage having at least a portion above said upper oven and having an air flow port at said front of the upper oven, said port defining an outlet opening when said cooling means is operating and said air moving means is inoperative, and defining an inlet for delivering cooling air through said upper passage to said air moving means when said air moving means is operating, said temperature responsive means being disposed in said upper passage.

11. The oven structure of claim 7 wherein said air moving means is disposed adjacent said bottom of the upper oven.

12. In an oven structure having first wall means defining a first oven cavity provided with an access opening and including a door for selectively closing said access opening, and second wall means defining a second oven cavity and having a bottom portion, the improvement comprising:

an air flow passage in said first wall means for passing cooling air therethrough to cool said wall means, said passage defining an inlet and an outlet; and air moving means forcibly flowing a stream of cooling air (a) firstly in heat transfer association with said second wall means bottom portion to cool the same and (b) secondly transversely across said outlet to suck air through said passage and discharge said sucked air remotely from said inlet to cool said first wall means.

13. The oven structure of claim 12 wherein said air flow passage is in said door.

14. The oven structure of claim 12 wherein said second wall means is disposed above said first wall means, said outlet is at a top portion of said air flow passage and said inlet is at a bottom portion thereof to provide convective air flow cooling of said wall means as an incident of concurrent heating operation of said oven structure and nonoperation of said air moving means.

15. The oven structure of claim 12 wherein means are provided for flowing cooling air convectively in heat transfer association with the exterior of said second wall means.

16. The oven structure of claim 12 wherein said air moving means is arranged to flow cooling air in heat transfer association with the exterior of a portion of said wall means defining the top of said oven cavity.

17. The oven structure of claim 12 wherein said air moving means is arranged to flow said stream of air in heat transfer association with said second wall means prior to its flow across said outlet.

18. The oven structure of claim 12 wherein said air moving means is arranged to flow at least a portion of said stream of air through said second oven cavity for cooling thereof.

19. The oven structure of claim 12 wherein said air moving means is arranged to flow at least a portion of said stream of air through said second oven cavity for cooling thereof prior to the flow thereof across said outlet in said stream.

* * * * *